US012145196B2

(12) United States Patent
Hori et al.

(10) Patent No.: US 12,145,196 B2
(45) Date of Patent: Nov. 19, 2024

(54) METHOD FOR MANUFACTURING CAST PRODUCT

(71) Applicant: TOYOTA JIDOSHA KABUSHIKI KAISHA, Toyota (JP)

(72) Inventors: Shoko Hori, Toyota (JP); Hirotsune Watanabe, Miyoshi (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 18/598,875

(22) Filed: Mar. 7, 2024

(65) Prior Publication Data

US 2024/0316625 A1 Sep. 26, 2024

(30) Foreign Application Priority Data

Mar. 22, 2023 (JP) ..... 2023-045845

(51) Int. Cl.
*B22D 29/00* (2006.01)

(52) U.S. Cl.
CPC ..... *B22D 29/003* (2013.01)

(58) Field of Classification Search
CPC ..... B22D 29/001–003
See application file for complete search history.

(56) References Cited

U.S. PATENT DOCUMENTS 4,141,781 A * 2/1979 Greskovich ..... B22D 29/002 216/101
2015/0246387 A1* 9/2015 Bartels ..... B22C 1/18 164/349
2018/0161867 A1 6/2018 Minamiguchi et al.

FOREIGN PATENT DOCUMENTS

WO 2016194100 A1 12/2016

* cited by examiner

*Primary Examiner* — Kevin P Kerns
*Assistant Examiner* — Steven S Ha
(74) *Attorney, Agent, or Firm* — Sughrue Mion, PLLC

(57) ABSTRACT

A method for manufacturing a cast product in which a core can be easily discharged from a casting roughly-shaped material is provided. A method for manufacturing a cast product according to the present disclosure includes: a step of hermetically sealing a casting roughly-shaped material formed by casting using a core in a container containing water; a step of heating the water contained in the container while keeping the casting roughly-shaped material hermetically sealed and thereby destroying the core while keeping a pressure inside the container at a pressure higher than an atmospheric pressure, and thereby forming core sand; and a step of discharging the core sand from the casting roughly-shaped material.

3 Claims, 4 Drawing Sheets

| No. | Concentration of Water Glass | Temperature of Water | Pressure inside Container | Core Destruction Rate |
|---|---|---|---|---|
| | [%] | [℃] | [MPa] | [%] |
| Example 1 | 0 | 117 | 0.15 | 40 |
| Example 2 | 1 | 122 | 0.16 | 57 |
| Example 3 | 3 | 122 | 0.16 | 96 |
| Example 4 | 5 | 122 | 0.16 | 100 |
| Comparative Example 1 | 0 | 100 | 0.10 (Atmospheric Pressure) | 16 |

Fig. 2

| No. | Before Implementation | After Implementation |
|---|---|---|
| 1 |   |   |
| 2 |   |   |
| 3 |   |   |

METHOD FOR MANUFACTURING CAST PRODUCT

CROSS REFERENCE TO RELATED APPLICATIONS

This application is based upon and claims the benefit of priority from Japanese patent application No. 2023-045845, filed on Mar. 22, 2023, the disclosure of which is incorporated herein in its entirety by reference.

BACKGROUND

The present disclosure relates to a method for manufacturing a cast product.

In a core discharging method disclosed in International Patent Publication No. WO2016/194100, the strength of a sand core formed of a binder containing water glass in a roughly-shaped material for a cast molded article is lowered by supplying a refrigerated and humidified gas to the sand core. After that, the sand core is destroyed by applying an impact force to the roughly-shaped material for the cast molded article by using a striking device. Further, the destroyed sand core is discharged from the roughly-shaped material for the cast molded article by vibrations applied by a vibrating device. The core discharging method disclosed in International Patent Publication No. WO2016/194100 can be suitably used for cast products.

SUMMARY

The inventors of the present application have found the following problem.

In a core discharging method like the one described above, in some cases, the humidified gas does not reach the inside of the sand core, so that the strength of the sand core is not sufficiently lowered. Therefore, in some cases, the sand core is not easily destroyed and discharged.

The present disclosure has been made in view of the above-described problem, and provides a method for manufacturing a cast product in which the core can be easily discharged from a casting roughly-shaped material.

A method for manufacturing a cast product according to the present disclosure includes:

- hermetically sealing a casting roughly-shaped material formed by casting using a core in a container containing water;
- heating the water contained in the container while keeping the casting roughly-shaped material hermetically sealed and thereby destroying the core while keeping a pressure inside the container at a pressure higher than an atmospheric pressure, and thereby forming core sand; and
- discharging the core sand from the casting roughly-shaped material.

Further, the core may be an inorganic core; the inorganic core may contain a binder and an aggregate; and the binder may contain water glass.

Further, in the forming of the core sand, the pressure inside the container may be kept at 0.15 MPa or higher.

Further, the water contained in the container may contain water glass, and a concentration of the water glass in the water in the container may be, by mass %, no lower than 3% and no higher than 5%.

According to the present disclosure, the core can be easily discharged from the casting roughly-shaped material.

The above and other objects, features and advantages of the present disclosure will become more fully understood from the detailed description given hereinbelow and the accompanying drawings which are given by way of illustration only, and thus are not to be considered as limiting the present disclosure.

BRIEF DESCRIPTION OF DRAWINGS

FIG. 2 is a table showing concentrations of water glass, temperatures of water, pressures inside containers, and destruction rates of cores in Examples 1 to 4 and Comparative Example 1;

DESCRIPTION OF EMBODIMENTS

The inventors of the present application have focused on the fact that the atmospheric pressure under the environment of a core affects the destruction property of the core, elaborately examined various factors including the atmospheric pressure, and conceived the present disclosure.

Specific embodiments to which the present disclosure is applied will be described hereinafter in detail with reference to the drawings. However, the present disclosure is not limited to the below-shown embodiments. Further, the following description and the drawings are simplified as appropriate for clarifying the explanation.

First Embodiment

Figure 1:
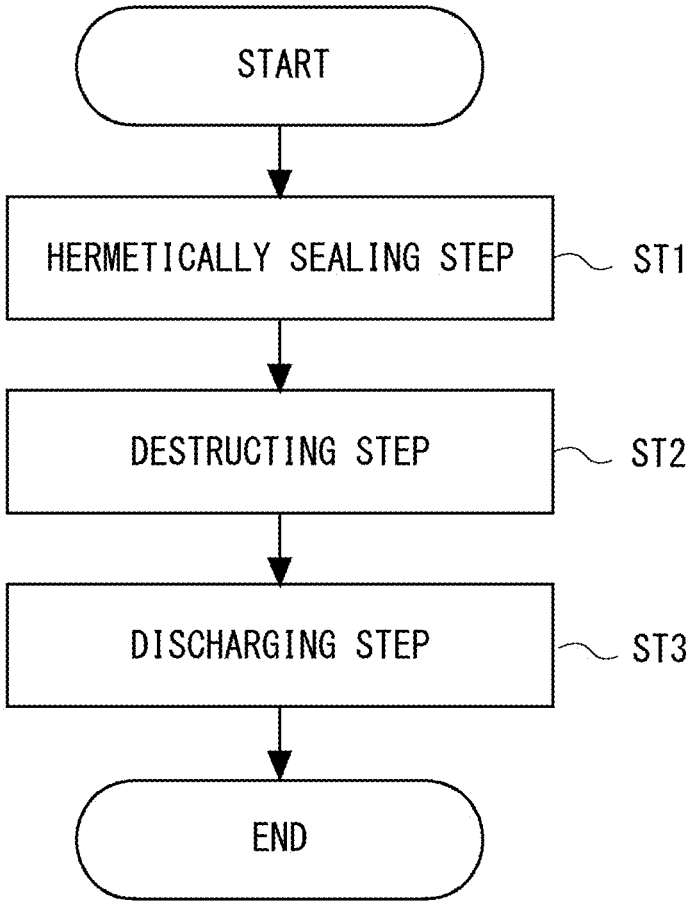
FIG. 1 is a flowchart showing a method for discharging a core according to a first embodiment.

A method for discharging a core (hereinafter also referred to as a core discharging method) according to a first embodiment will be described with reference to FIG. 1.

A casting roughly-shaped material (i.e., a roughly-shaped material for casting) is hermetically sealed in a container containing water (Step ST1).

This container may have an internal space in which water and a casting roughly-shaped material can be hermetically sealed, and this internal space is preferably be able to be heated. This container is preferably configured so that the pressure inside the container exceeds the atmospheric pressure, and preferably include, for example, a heating device that heats water. For example, the container is a pressure cooker.

Further, the water contained in the container may contain water glass. The concentration of the water glass in the water in the container is preferably, by mass %, no lower than 1% and no higher than 5%, and more preferably no lower than 3%, and no higher than 5%. The concentration of the water glass can be changed by adding a solid content of water glass to the water.

Further, the casting roughly-shaped material is formed by casting using a core (i.e., the casting roughly-shaped material can be casted by using a core). This casting roughly-shaped material has an internal space, and a core is disposed in this internal space. This casting roughly-shaped material is made of a metallic material such as pure aluminum or an aluminum alloy. A casting method for forming such a casting roughly-shaped material is not limited to any particular methods and can be selected from various casting methods such as a gravity casting method, a low-pressure casting method, a die casting method, and a suction casting method.

Further, the core may be preferably a water-soluble type and is, for example, a core containing water glass as a binder. This core may be preferably an inorganic core, and preferably contains, for example, a binder and an aggregate. The aggregate preferably contains sand. This inorganic core may further contain an additive or the like as required. An example of a method for manufacturing such a core will be described. Firstly, a kneaded material is formed by mixing and kneading materials such as an aggregate and a binder. Further, this kneaded material is charged into the cavity of a core mold. Further, a core is formed by heat-curing (or heat-hardening) this kneaded material charged into the cavity of the core mold. For this heat-curing, the core mold is heated by using a heater, heated by irradiating the kneaded material and the core mold made of a resin with microwaves, or heated by blowing hot air into the cavity of the core mold. Lastly, this core is removed from the core mold.

Next, core sand is formed by heating the water contained in the container while keeping the casting roughly-shaped material hermetically sealed and thereby destroying the core while keeping the pressure inside the container at a pressure higher than the atmospheric pressure (Step ST2). Superheated steam is preferably generated inside the container by this heating.

The pressure inside the container preferably exceeds the atmospheric pressure, for example, exceeds 0.10 MPa. Specifically, the pressure is preferably kept at 0.15 MPa, or 0.16 MPa or higher. Further, the heating time during which the water contained in the container is heated is preferably determined empirically according to the surface area of the core, the volume of the core and the like.

The water contained in the container preferably contains water glass, and the concentration of the water glass in the water in the container is preferably, by mass %, no lower than 1% and no higher than 5%, and more preferably no lower than 3% and no higher than 5%.

Lastly, the core sand is discharged from the casting roughly-shaped material (Step ST3). For example, the core sand may be discharged from the casting roughly-shaped material by making water flow into the core sand. Note that when a part of the core remains without being destroyed in the step ST2, the remaining part of the core may be discharged from the casting roughly-shaped material by using a vibrating device or a striking device as appropriate.

Through the above-described series of processes, the pressure inside the container is kept at a pressure higher than the atmospheric pressure by heating the water contained in the container while keeping the casting roughly-shaped material hermetically sealed. Therefore, superheated steam may come into contact with the core and reach the inside of the core. In this way, the strength of the core is sufficiently lowered and the core receives the pressure. As a result, the core is destroyed, so that the core sand is formed. Since the core sand is a powder or is composed of grains, it can be easily moved from the internal space of the casting roughly-shaped material to the outside of the casting roughly-shaped material by making water flow thereinto. That is, the core can be easily discharged from the casting roughly-shaped material.

Further, according to the configuration of the method for discharging a core according to the first embodiment, the core sand can be further formed by limiting the pressure inside the container and the concentration of the water glass in the water in the container to predetermined ranges. For example, when roughly the whole core is destroyed and the core sand is thereby formed in the step ST2, the core can be discharged from the casting roughly-shaped material without applying an impact force nor vibrations to the core. That is, the core can be easily discharged from the casting roughly-shaped material without using a vibrating device nor a striking device.

Further, the method for discharging a core according to the first embodiment is preferably incorporated into a method for manufacturing a cast product. In such a method for manufacturing a cast product, the core can be easily discharged from the casting roughly-shaped material, so that the cast product can be easily manufactured.

EXAMPLES

Next, results of verifications for examples of the steps ST1 and ST2 in the method for discharging a core according to the first embodiment will be described with reference to FIGS. 2 and 3.

In Examples 1 to 4, steps corresponding to the steps ST1 and ST2 in the method for discharging a core according to the first embodiment were implemented, and the destruction rates of cores (hereinafter also referred to as core destruction rates) were determined. FIGS. 2 and 3 show the obtained results.

The core destruction rate RC can be obtained by determining (e.g., calculating) a difference between the weight of a core W0 before the implementation (i.e., the implementation of the steps) and the weight of a core W1 after the implementation, and dividing the determined difference by the weight of the core W0 before the implementation. That is, the core destruction rate RC can be determined by using the below-shown relational expression.

$$RC = (W0 - W1)/W0$$

Each of the core test pieces was formed by heat-curing (or heat-hardening) a kneaded material containing recycled sand of an inorganic core at a mold temperature of 260° C. by using a muffle furnace. The inorganic core contains water glass. After that, the core test piece was left undisturbed and thereby cooled to a 100° C. or lower. A pressure cooker was used as the container. This pressure cooker includes a lid, and this lid is equipped with a thermometer and a pressure gauge. The core test piece was placed on a net, and they were placed inside the pressure cooker as they were. A step corresponding to the step ST2 was implemented under conditions shown in FIG. 2, i.e., with the concentration of the water glass in the water in the container, the water temperature, and the pressure inside the container shown in FIG. 2. The heating times in Examples 1 to 4 were set to 1 min, 5 min, 5 min, and 5 min, respectively. The weight of the core before being placed on the net was defined as a core weight W0, and the weight of the core remaining on the net was defined as a core weight W1.

Note that in Comparative Example 1, a core destruction rate was obtained by implementing a core discharging method different from that according to the first embodiment. FIGS. 2 and 3 show the obtained results. In this other core discharging method, firstly, a core test piece was placed in a container containing water. This container was not hermetically sealed and was open to the atmosphere. Further, the pressure inside the container was kept at the atmospheric pressure by heating the water contained in the container. The core test piece and the container used in Comparative Example 1 were the same as those used in Examples 1 to 4. The other core discharging method was implemented under conditions shown in FIG. 2, i.e., with the concentration of the water glass in the water in the container, the water temperature, and the pressure inside the container shown in FIG. 2.

Figure 3:
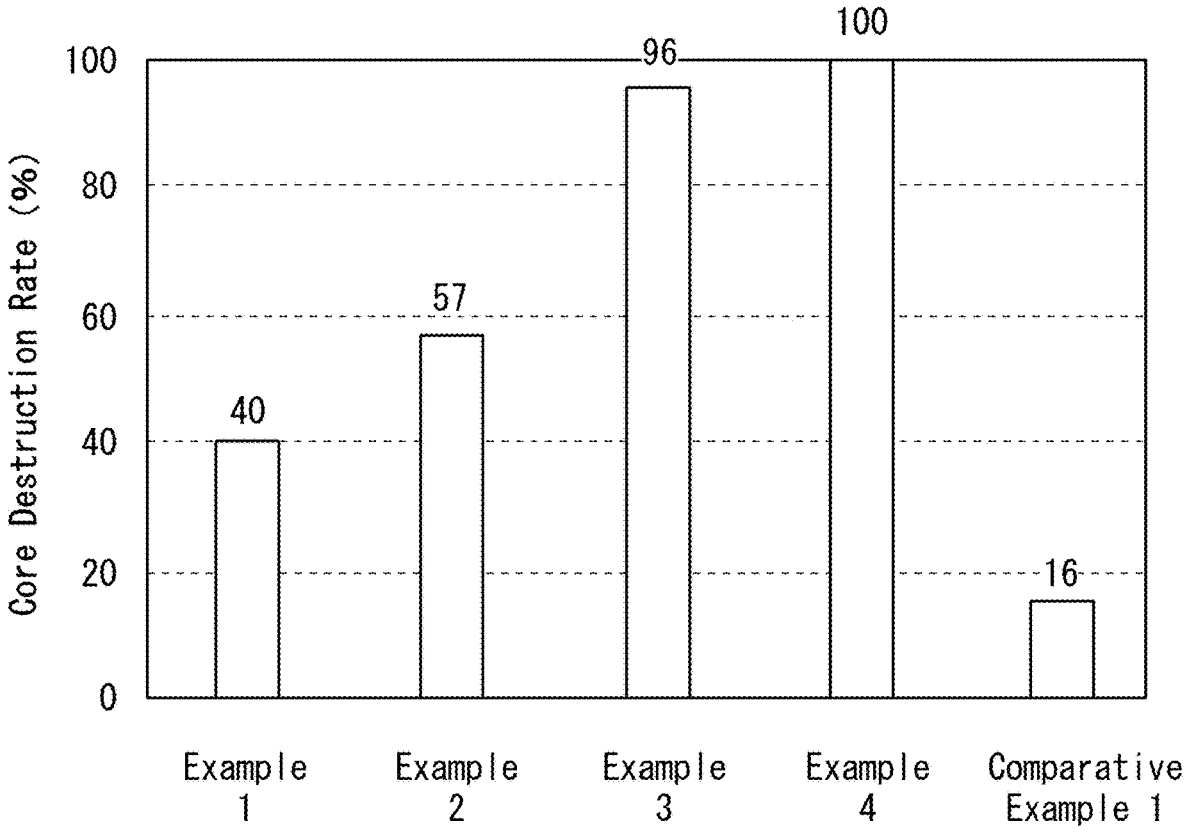
FIG. 3 is a graph showing destruction rates of cores in Examples 1 to 4 and Comparative Example 1.

As shown in FIG. 3, in Examples 1 to 4, the core destruction rates were 40% or higher, i.e., had excellent values. In contrast, in Comparative Example 1, the core destruction rate was 16% and was lower than those in Examples 1 to 4. One of the reasons for this is that the pressure inside the container was higher in Examples 1 to 4 than in Comparative Example 1, and the pressure was kept at a pressure higher than the atmospheric pressure.

In Examples 2 to 4, the core destruction rates were 57% or higher, i.e., had higher values. One of the reasons for this is that the concentrations of the water glass in the water in the container in Examples 2 to 4 were higher than that in Example 1, and were, by mass %, no lower than 1% and no higher than 5%.

Further, in Examples 3 and 4, the core destruction rates were 96% or higher, i.e., had particularly higher values. One of the reasons for this is that the concentrations of the water glass in the water in the container were higher in Examples 3 and 4 than those in Examples 1 and 2, and were, by mass %, no lower than 3% and no higher than 5%.

Next, Example 5 in which an example of the method for discharging a core according to the first embodiment was applied will be described with reference to FIG. 4.

In Example 5, a roughly-shaped material for a cylinder head casting was used as the casting roughly-shaped material. The shape of the roughly-shaped material for the cylinder head casting was more complicated and the size thereof was larger than those of the above-described core test pieces. An inorganic core containing water glass was used as the core. The roughly-shaped material for the cylinder head casting was formed by using a low-pressure casting method. The concentration of the water glass in the water in the container was 5% by mass %. Further, the highest temperature of the water contained in the container was 122° C. The time during which the roughly-shaped material for the cylinder head casting was heated at 120° C. or higher was 5 minutes.

The roughly-shaped material for the cylinder head casting was left undisturbed in the atmosphere in the as-cast state for two weeks, and then kept in a dry environment using a desiccant for two weeks. That is, the roughly-shaped material for the cylinder head casting was placed under an environment where the core was more likely to remain than in a conventional manufacturing line. The roughly-shaped material for the cylinder head casting was cut and divided into parts C1, C2 and C3. For each of the parts C1, C2 and C3, an example of a core discharging method was implemented. Note that neither vibrations nor impact was applied to the roughly-shaped material for the cylinder head casting by using a vibrating device or a striking device. FIG. 4 shows the parts C1, C2 and C3 of the roughly-shaped material for the cylinder head casting before the example of the core discharging method was implemented and those after the example of the core discharging method was implemented.

Figure 4:
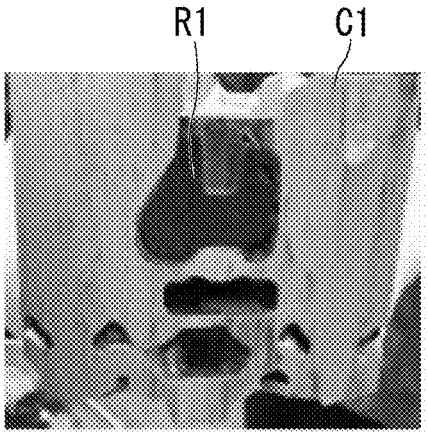
FIG. 4 shows an example in which a method for discharging a core according to the first embodiment is applied.
Figure 4:
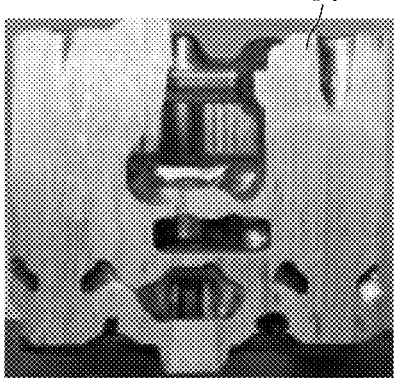
Figure 4:
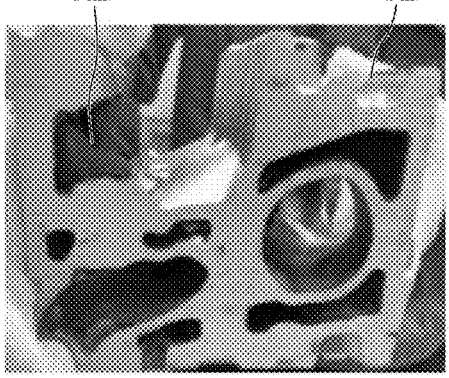
Figure 4:
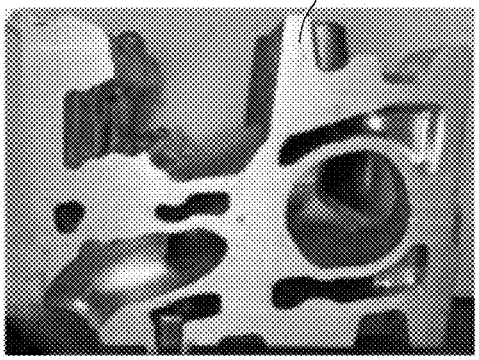
Figure 4:
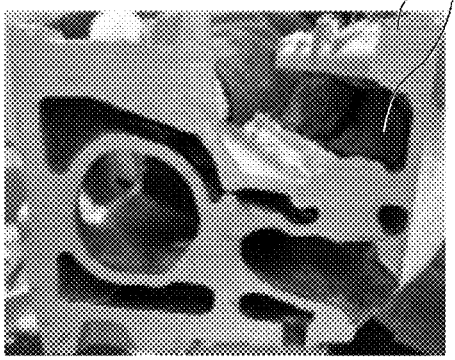
Figure 4:
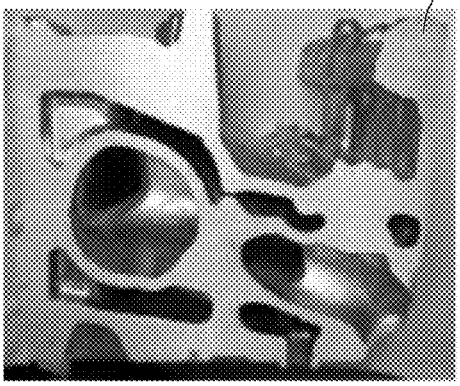

As shown in FIG. 4, in the part C1 of the roughly-shaped material for the cylinder head casting before the implementation, the core R1 remained and was stuck to the inner wall surface of the internal space of the part C1. In contrast, in the part C1 of the roughly-shaped material for the cylinder head casting after the implementation, neither the core R1 nor sand was observed. That is, the core R1 was able to be easily discharged from the part C1. Further, the cores R2 and R3, which remained in the parts C2 and C3, respectively, of the roughly-shaped material for the cylinder head casting before the implementation were also be able to be easily discharged from the parts C2 and C3, respectively, as in the case of the core R1. Based on the above-described facts, the cores R1, R2 and R3 were able to be discharged from the roughly-shaped material for the cylinder head casting without applying an impact force or vibrations to the cores R1, R2 and R3. That is, the cores R1, R2 and R3 were able to be easily discharged from the parts C1, C2 and C3, respectively, of the roughly-shaped material for the cylinder head casting. Note that the present disclosure is not limited to the above-described embodiments, and they can be modified as appropriate without departing from the scope and spirit of the disclosure. Further, the present disclosure may also be implemented by combining the above-described embodiments and their examples as appropriate.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A method for manufacturing a cast product, comprising:

hermetically sealing a casting roughly-shaped material formed by casting using a core in a container containing water;

heating the water contained in the container while keeping the casting roughly-shaped material hermetically sealed and thereby destroying the core while keeping a pressure inside the container at a pressure higher than an atmospheric pressure, and thereby forming core sand; and discharging the core sand from the casting roughly-shaped material, wherein the water contained in the container contains water glass, and a concentration of the water glass in the water in the container is, by mass %, no lower than 3% and no higher than 5%.

2. The method for manufacturing a cast product according to claim 1, wherein the core is an inorganic core, the inorganic core contains a binder and an aggregate, and the binder contains water glass.

3. The method for manufacturing a cast product according to claim 1, wherein in the forming of the core sand, the pressure inside the container is kept at 0.15 MPa or higher.

* * * * *